US005696473A

United States Patent [19]

Tsujiguchi et al.

[11] Patent Number: 5,696,473

[45] Date of Patent: Dec. 9, 1997

[54] DIELECTRIC FILTER HAVING A NON-RIGHT ANGLE STEPPED END SURFACE

[75] Inventors: Tatsuya Tsujiguchi, Kanazawa; Hitoshi Tada, Ishikawa-ken, both of Japan

[73] Assignee: Murata Manufacturing Co., Ltd., Japan

[21] Appl. No.: 391,767

[22] Filed: Feb. 21, 1995

[30] Foreign Application Priority Data

Feb. 22, 1994 [JP] Japan ..... HEI 6-024200

[51] Int. Cl.[6] ..... H01P 1/205

[52] U.S. Cl. ..... 333/202; 333/206

[58] Field of Search ..... 333/202, 206, 333/222, 202 DB, 207, 223

[56] References Cited

FOREIGN PATENT DOCUMENTS

| | | | |
|---|---|---|---|
| 281101 | 12/1986 | Japan | 333/202 DB |
| 220502 | 9/1989 | Japan | 333/202 DB |
| 205903 | 9/1991 | Japan | 333/206 |
| 4088707 | 3/1992 | Japan | 333/202 DB |
| 6021704 | 1/1994 | Japan | 333/202 DB |
| 6090104 | 3/1994 | Japan | 333/206 |

*Primary Examiner*—Benny Lee

*Attorney, Agent, or Firm*—Ostrolenk, Faber, Gerb & Soffen, LLP

[57] ABSTRACT

A dielectric filter has a stepped resonator hole and straight resonator holes. A portion of a short-circuited end surface of the dielectric block, corresponding to a resonator formed in the stepped resonator hole, is removed, so that the short-circuited end surface has a stepped shape defined by a step surface. Thus the stepped resonator is shorter than the straight resonators. It is thus possible to provide a filter in which the respective resonant frequencies of the resonators are substantially the same, and inner conductor-free portions in the stepped hole and straight holes may be formed at substantially the same distances from an open-circuited end surface, while still obtaining firm coupling between the resonators.

10 Claims, 5 Drawing Sheets

DIELECTRIC FILTER HAVING A NON-RIGHT ANGLE STEPPED END SURFACE

BACKGROUND OF THE INVENTION

1. Field of the Invention

The present invention relates to a dielectric filter, and more particularly, to a dielectric filter in which a plurality of dielectric resonators are formed as one unit in a single dielectric block.

2. Description of Related Art

In dielectric filters in which a plurality of dielectric resonators are coupled to each other, an attenuation pole is generally obtained at a low-frequency side of a passband when capacitive coupling is produced between adjacent resonators, and an attenuation pole is obtained at a high-frequency side of the passband when inductive coupling is provided between adjacent resonators.

Conventional dielectric filters having attenuation poles $G_L$ and $G_H$ at the low-and high-frequency sides of a passband, respectively, as shown in FIG. 5, may have a configuration shown in, for example, FIGS. 4(*a*) and 4(*b*). In the attached figures, shaded portions indicate portions where the material of a dielectric block is exposed.

In the dielectric filter, three resonator holes 2*a*, 2*b* and 2*c* are formed in a substantially rectangular parallelepiped-shaped dielectric block 1 in such a manner that they pass through a pair of end surfaces 1*a* and 1*b* of the dielectric block 1, as shown in FIGS. 4(*a*) and 4(*b*). An inner conductor 3 (see FIG. 4(*b*)) is formed on the inner surface of each of the resonator holes 2*a*, 2*b* and 2*c*. A pair of input-output electrodes 5 (see FIG. 4(*a*)) are formed on a predetermined position of the outer surface of the dielectric block 1, and an outer conductor 4 is formed on almost the entire surface of the outer surface of the dielectric block 1 with the exception of the area where the input/output electrodes 5 are formed.

In each of the resonator holes 2*a*, 2*b* and 2*c*, a portion 3*a* where no inner conductor 3 is formed (hereinafter referred to as an "inner conductor-free" portion) is provided near one end surface 1*a* to which the resonator holes 2*a*, 2*b* and 2*c* are opened (hereinafter the end surface 1*a* being referred to as an "open-circuited end surface" 1*a*) to open-circuit or separate the inner conductor 3 from the outer conductor 4. The inner conductor 3 is short-circuited (electrically connected) to the outer conductor 4 at the other end surface 1*b* (hereinafter referred to as a "short-circuited end surface" 1*b*).

The inner conductor-free portion 3*a* is formed after formation of the inner conductor 3 by removing part of the inner peripheral surface of the inner conductor 3 by means of, for example, a grindstone.

The resonator hole 2*a* constitutes a resonator hole having a stepped portion (hereinafter, the resonator hole 2*a* being referred to as a "stepped hole"), that is, the resonator hole 2*a* has a stepped portion 21 (see FIG. 4(*b*)) at substantially the midpoint between the open-circuited end surface 1*a* and the short-circuited end surface 1*b*, whereby the inner diameter of the portion of the resonator hole 2*a* extending from the open-circuited end surface 1*a* to the stepped portion 21 is larger than the inner diameter of the portion of the resonator hole 2*a* extending from the short-circuited end surface 1*b* to the stepped portion 21.

The resonator holes 2*b* and 2*c* each have a fixed inner diameter, that is, the resonator holes 2*b* and 2*c* constitute resonator holes having no stepped portion (hereinafter, the resonator holes 2*b* and 2*c* being referred to as "straight holes").

The resonators respectively formed in the resonator holes 2*a*, 2*b* and 2*c* are so-called comb-line-coupled to each other by means of a capacitance produced between the portions of the inner conductors 3 located respectively on the two sides of each of the inner conductor-free portions 3*a*.

A further capacitance is produced between the inner conductor 3 in each of the resonator holes 2*a* and 2*c*, serving as input and output stages, and each of the input/output electrodes 5, whereby the inner conductors 3 in the resonator holes 2*a* and 2*c* are respectively coupled to the input/output electrodes 5, which are in turn disposed for being connected to an external circuit.

The dielectric filter arranged in the manner described above is mounted on a substrate with a bottom surface 1*c* (which is the upper surface as viewed in FIG. 4*a*)) on which the input/output electrodes 5 are formed facing the substrate.

In the above-described dielectric filter, since the resonator hole 2*a* is a stepped hole and the electrical energy associated with the coupling is thus increased, the resonators formed in the adjoining resonator holes 2*a* and 2*b* are capacitively coupled to each other, thus forming an attenuation pole at the low-frequency side of a passband.

The two resonators formed in the adjacent straight resonator holes 2*b* and 2*c* are so-called comb-line coupled to each other by means of the capacitance formed by the inner conductor-free portion 3*a* at a location in the vicinity of but spaced away from the end surface of the dielectric block 1. That is, the two resonators are inductively coupled to each other, thus forming an attenuation pole at the high-frequency side of a passband. Thus, a dielectric filter respectively having attenuation poles $G_L$ and $G_H$ at the low and high-frequency sides of the passband, as shown in FIG. 5, is provided.

However, the resonant frequency of the resonator formed in the stepped hole is much lower than the resonant frequency of the resonator formed in each straight hole. Therefore, in a case where a filter is formed from a single dielectric filter having both stepped and straight holes, the lengths of the resonators must be adjusted by some suitable method.

Hence, in the conventional dielectric filter shown in FIGS. 4(*a*) and 4(*b*) having a combination of the stepped hole and the straight holes, the lengths of the resonators are adjusted by forming the inner conductor-free portions at different positions to make the resonant frequencies of the resonators formed in the respective resonator holes substantially the same. More specifically, the inner conductor-free portion 3*a* in the resonator hole 2*a* is formed at a position deeper than the positions where the inner conductor-free portions 3*a* are formed in the resonator holes 2*b* and 2*c* so that an effective resonator length La of the resonator hole (stepped hole) 2*a* can be made shorter than the effective resonator lengths Lb and Lc formed by the resonator holes (straight holes) 2*b* and 2*c*, as shown in FIG. 4(*b*).

Accordingly, the position of the open end of the resonator formed in the stepped hole is shifted to below the position of the open end of the resonator formed in the adjacent straight hole, weakening coupling by means of an electric field between those resonators. Consequently, it is difficult to obtain a firm capacitive coupling between the resonators, i.e., it is difficult to provide a filter having a wide passband.

Furthermore, since the inner conductor-free portion formed in the stepped hole is located relatively far from the open-circuited end surface, formation of the inner conductor-free portion is difficult, thus increasing the amount of time required for the manufacturing process.

SUMMARY OF THE INVENTION

In view of the aforementioned problems of the conventional dielectric filter, an object of the present invention is to provide an inexpensive and small dielectric filter having a wide passband which enables the resonant frequencies of respective resonators in a single dielectric block to be set to approximately or exactly the same value, without requiring the open ends of the respective resonators to be an substantially different positions in order to obtain firm coupling between the respective resonators.

To achieve the above and other objects, according to an embodiment of the present invention, a dielectric filter may comprise a dielectric block having a pair of opposing end surfaces, one end surface being an open-circuited end surface while the other end surface being a short-circuited end surface, the filter body having a resonator hole with a stepped portion and a resonator hole having no stepped portion, the resonator holes extending between the two end surfaces, an inner conductor formed on an inner surface of each of the resonator holes, and an outer conductor formed on an outer surface of the dielectric block, wherein a portion is removed from the short-circuited end surface of the dielectric block, adjacent to a resonator formed in the resonator hole having a stepped portion, so that the short-circuited end surface has a stepped shape defined by a step surface.

In a preferred embodiment of the invention, an inner conductor-free portion is provided in the inner conductor near the open-circuited end surface of the dielectric block to separate the inner conductor from the outer conductor.

In another preferred embodiment of the invention, an outer conductor-free portion is provided on all or part of the open-circuited end surface of the dielectric block to separate the inner conductor from the outer conductor.

In the preferred embodiments, because a portion of the short-circuited end surface is removed from the dielectric block, corresponding to the resonator formed in the resonator hole having a stepped portion, the length of that resonator, i.e., the resonant frequency thereof, can be set or adjusted to a desired value without providing the open end of the resonator at a position significantly different from the positions of the open ends of the other resonators.

In this context, there are references herein to the inner conductor-free portions being formed at "substantially the same" or "almost the same" distances from the open-circuited end of the dielectric block, to define the open ends of the resonators. Exact equality of the respective distances is not necessary. What is meant is that because of the inventive shape of the dielectric block, including a shortened portion adjacent to the stepped hole, it is possible according to this invention to provide an inexpensive and small dielectric filter having a wide passband which enables the resonant frequencies of respective resonators in a single dielectric block to be set to approximately or exactly the same value, without requiring the open ends of the respective resonators to be at substantially different positions in order to obtain firm coupling between the respective resonators. Likewise, the respective resonant frequencies of the resonators need not be exactly the same. Rather, the above-mentioned measurements may be either the same or slightly different, as acceptable according to well-known principles of filter design, as will be understood by persons having the ordinary level of skill in the pertinent art.

Other objects, features and advantages of the invention will become apparent from the following discussion of embodiments of the invention, with reference to the accompanying drawings.

BRIEF DESCRIPTION OF THE DRAWINGS

FIG. 1(*b*) is a cross-sectional view taken along the central horizontal plane of the dielectric filter shown in FIG. 1(*a*) ;

FIG. 4(*b*) is a cross-sectional view taken along the central horizontal plane of FIG. 4(*a*);

DESCRIPTION OF PREFERRED EMBODIMENTS

Figure 4A:
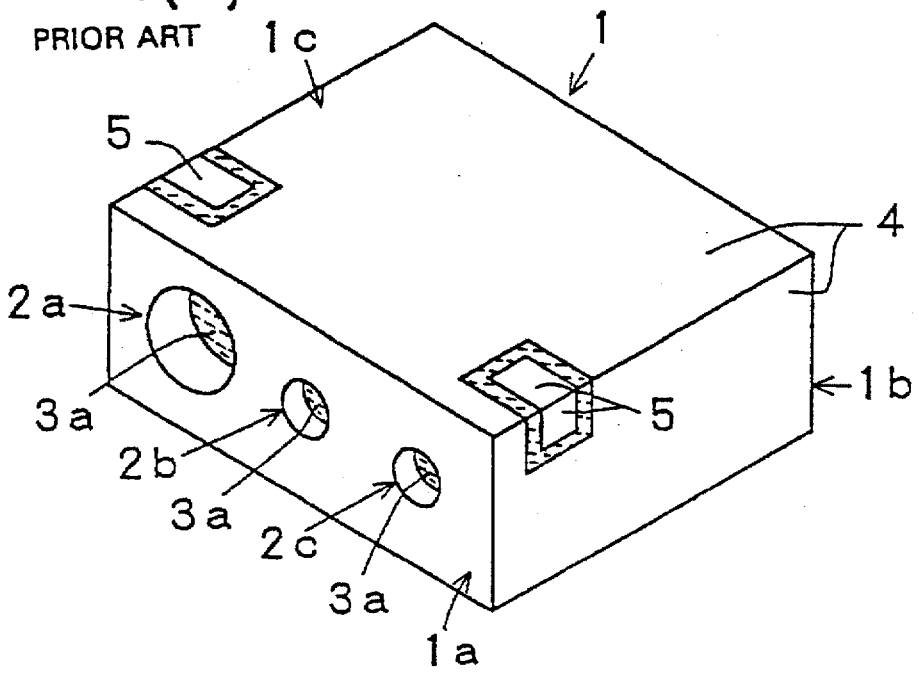
FIG. 4(a) PRIOR ART
FIG. 4(*a*) is a perspective view of a conventional dielectric filter.
Figure 4B:
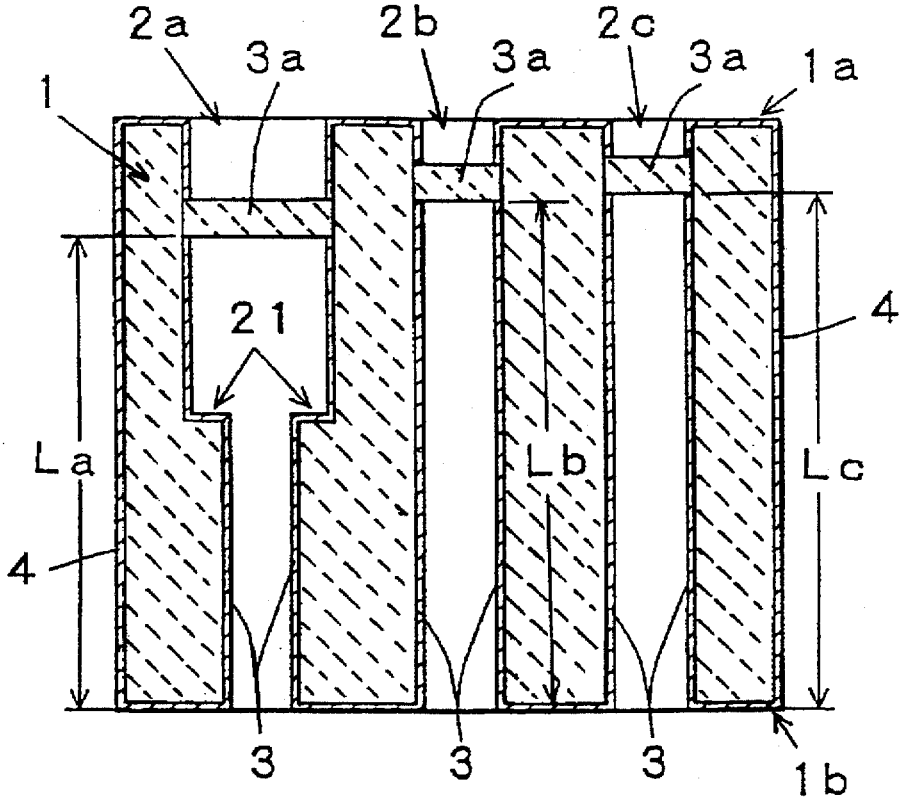
FIG. 4(b) PRIOR ART
Figure 5:
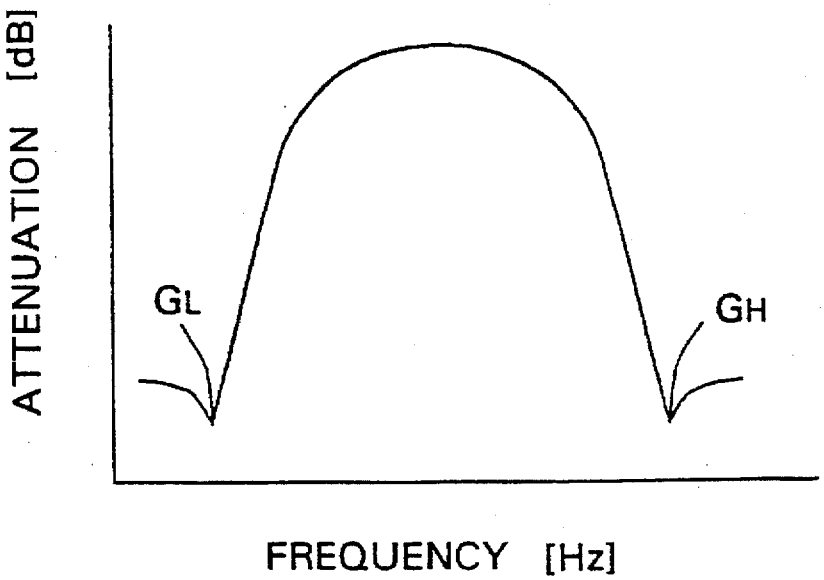
FIG. 5 PRIOR ART
FIG. 5 is a graphic representation of the frequency characteristics of a conventional filter having a single attenuation pole at each of the two sides of a passband.

Embodiments of the present invention will now be described below with reference to the accompanying drawings. Reference numerals in these figures identical to those in FIGS. 4(*a*) and 4(*b*) represent similar or identical elements.

Figure 1A:
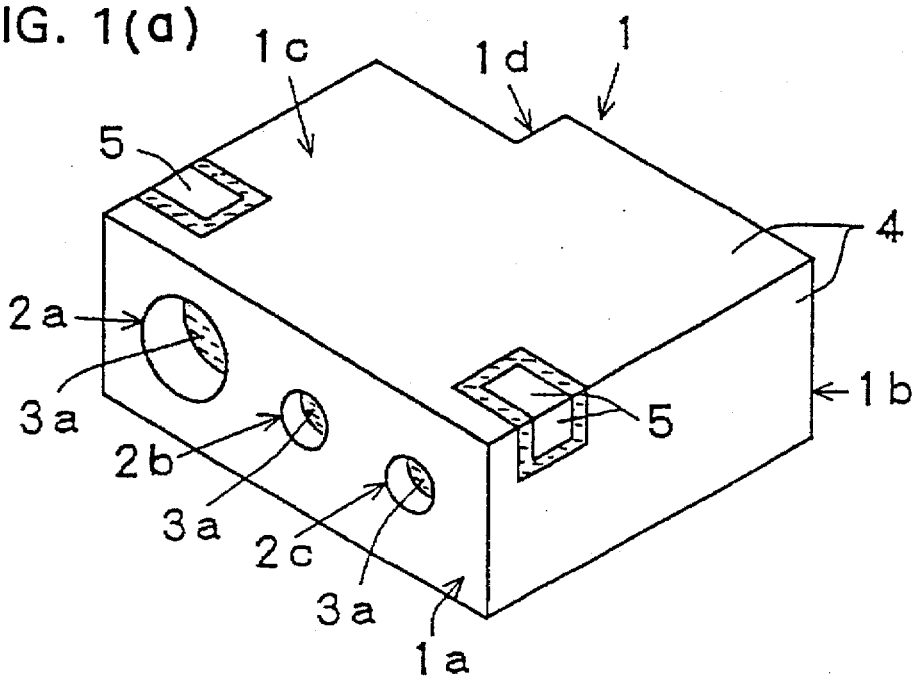
FIG. 1(*a*) is a perspective view of a first embodiment of a dielectric filter according to the present invention.
Figure 1B:
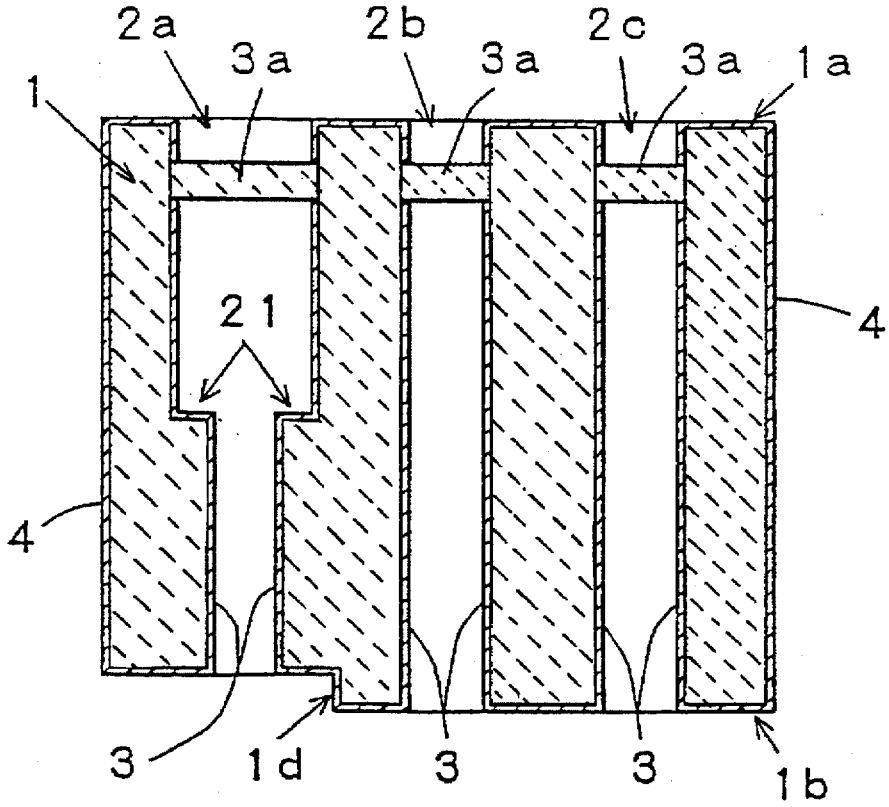

FIGS. 1(*a*) and 1(*b*) illustrate a first embodiment of a dielectric filter according to the present invention. FIG. 1(*a*) is a perspective view of the dielectric filter as viewed from the direction of the open-circuited end surface and bottom surface thereof, and FIG. 1(*b*) is a cross-sectional view taken along the central horizontal plane of FIG. 1(*a*).

In the dielectric filter shown in FIGS. 1(*a*) and 1(*b*), the dielectric block 1 has a first resonator hole (the stepped hole) 2*a* having a stepped portion and second and third resonator holes (the straight holes) 2*b* and 2*c* each having no stepped portion. The resonator holes 2*a*, 2*b* and 2*c* extend in the dielectric block 1 between the open end surface 1*a* and the short-circuited end surface 1*b*. A portion of the short-circuited end surface 1*b* of the dielectric block 1, corresponding to the resonator formed in the resonator hole 2*a*, is removed so that the short-circuited end surface 1*b* can be formed in a stepped shape having a step surface 1*d*. An inner conductor-free portion 3*a* is formed in the resonator hole 2*a* at almost the same position as respective inner conductor-free portions 3*a* in the resonator holes 2*b* and 2*c*. The outer conductor 4 is formed on the outer surface of the dielectric block 1 including the step surface 1*d* on the short-circuited end surface 1*b*. The other structures shown are the same as those of the conventional dielectric filter shown in FIGS. 4(*a*) and 4(*b*), description thereof being omitted.

Thus, in the conventional dielectric filter, the resonator formed in the stepped hole is shortened by moving the inner conductor-free portion downward, away from the open-circuited end surface. In contrast, in this embodiment, the resonator formed in the stepped hole is shortened by removing a portion of the short-circuited end surface of the dielectric block adjacent that resonator, to thereby shorten the portion of the dielectric block corresponding to that resonator, and hence the length of that resonator.

The stepped short-circuited end surface in the preceding embodiment is formed when the dielectric block is formed.

Alternatively, the stepped short-circuited end surface may be formed after the dielectric block has been formed, by cutting, for example.

In this embodiment, since part of the short-circuited end surface of the dielectric block is removed to shorten the length of that portion of the dielectric block, corresponding to the resonator formed in the stepped hole, the open end of the resonator in the stepped hole and the open ends of the resonators in the straight holes can be located at almost the same distance from the open-circuited end surface of the dielectric block. That is, the distances between the inner conductor-free portions 3*a* in the resonator holes 2*a*, 2*b* and 2*c* and the open-circuited end surface 1*a* can be made almost the same, as shown in FIG. 1(*b*).

Thus, although there is no change in the coupling between the two resonators formed in the resonator holes 2*b* and 2*c*, as compared with the conventional dielectric filter, capacitive coupling between the two resonators formed in the resonator holes 2*a* and 2*b* is stronger than in the conventional dielectric filter and firm capacitive coupling deriving from the stepped hole is obtained. Consequently, it is possible to provide a filter having a wider passband than that of the conventional filter shown in FIGS. 4(*a*) and 4(*b*) and with an attenuation pole at each of the low- and high-frequency sides of the passband.

Further, since the inner conductor-free portion 3*a* in the resonator hole 2*a*, which is the stepped hole, can be formed close to the open-circuited end surface 1*a*, formation thereof is facilitated, thus reducing the time required to manufacture the filter.

In this embodiment, if a coupling hole or groove is provided between the resonator holes 2*b* and 2*c* which are the straight holes, inductive coupling between the two resonators can be further enhanced, enabling a dielectric filter having a wider passband to be provided.

Figure 6:
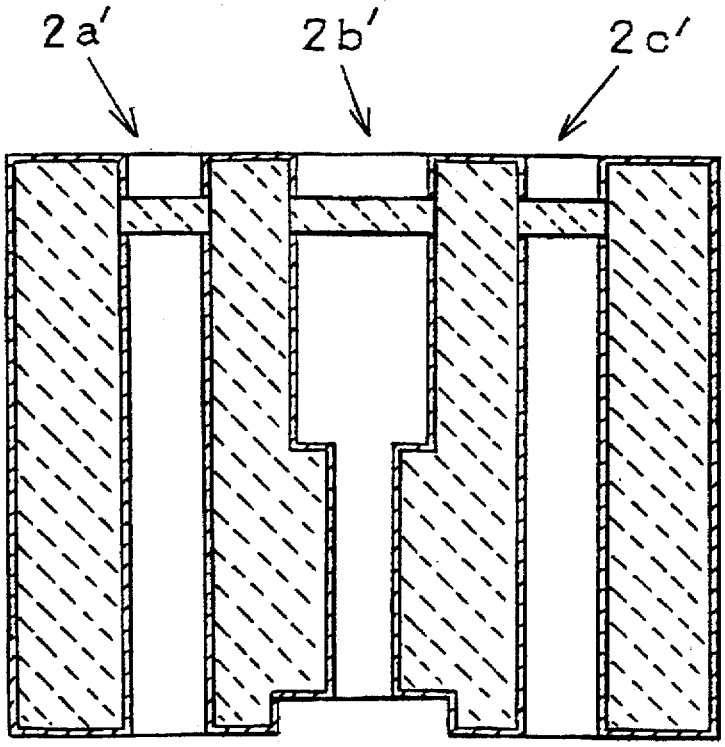
FIG. 6 is a cross-sectional view showing a modification of the first embodiment of a dielectric filter according to the present invention.

A further modification of the first embodiment is shown in FIG. 6, which is identical to FIG. 1(*b*) except that the first and last resonator holes 2*a*' and 2*c*' are straight holes, while the middle resonator hole 2*b*' is a stepped hole.

A second embodiment of the present invention will now be described with reference to FIG. 2.

Figure 2:
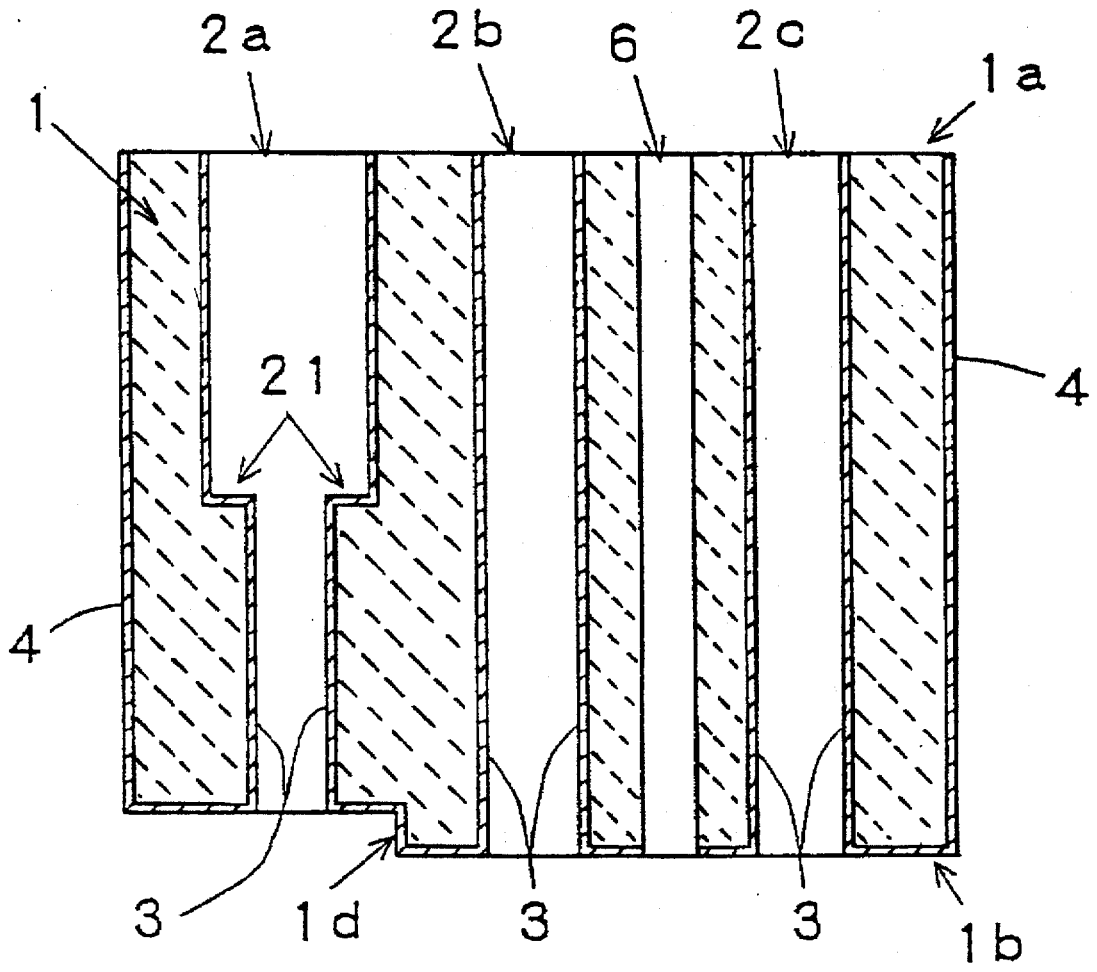
FIG. 2 is a cross-sectional view of a second embodiment of a dielectric filter according to the present invention.

In this embodiment, no outer conductor 4 is formed on the open-circuited end surface 1*a* of the dielectric filter to separate (open-circuit) the inner conductor 3 from the outer conductor 4, as shown in FIG. 2. Therefore, no inner conductor-free portion is provided in the inner conductors 3 in the resonator holes 2*a*, 2*b* and 2*c*, and the open ends of the resonators formed in the resonator holes 2*a*, 2*b* and 2*c* are at the open-circuited end surface 1*a*. A coupling hole 6 is provided between the resonator holes 2*b* and 2*c* which are the straight holes, to couple the resonators formed in the resonator holes 2*b* and 2*c*. Other structures are the same as that of the embodiment shown in FIGS. 1(*a*) and 1(*b*), and description thereof is therefore omitted.

In this embodiment, the same filter characteristics as those of the first embodiment are obtained. In other words, the resonator formed in the resonator hole 2*a* which is the stepped hole is capacitively coupled to the resonator formed in the resonator hole 2*b* which is the straight hole, while the resonator in the resonator hole 2*b* is inductively coupled to the resonator formed in the resonator hole 2*c*. It is thus possible to offer filter characteristics which have a wide passband and an attenuation pole at each of the low- and high-frequency sides of that passband.

In this embodiment, the coupling hole 6 is provided between the resonator holes 2*b* and 2*c*. Alternate coupling means might include a coupling groove (not shown) provided in the outer surface of the dielectric block between the resonator holes 2*b* and 2*c*.

In the case where both a stepped hole and a straight hole are formed in the single dielectric block and where the open ends of the respective resonators are at the open-circuited end surface thereof, as in this embodiment, the resonant frequencies of the respective lB resonators can be readily set. In contrast, it is difficult in the conventional filter shown in FIGS. 4(*a*) and 4(*b*) to set the resonant frequency of the resonator in the stepped hole close to the resonant frequency of the resonator in the straight hole.

Figure 3A:
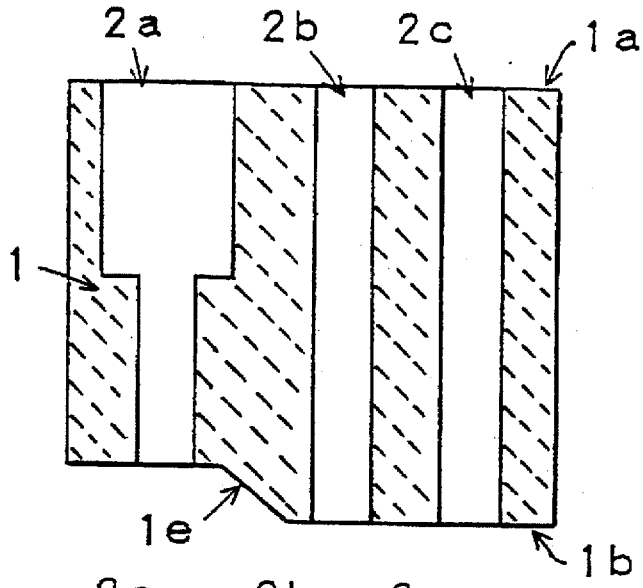
FIGS. 3(*a*), 3(*b*) and 3(*c*) are respectively cross-sectional views illustrating modifications of a stepped shape of a short-circuited end surface in the present invention.
Figure 3B:
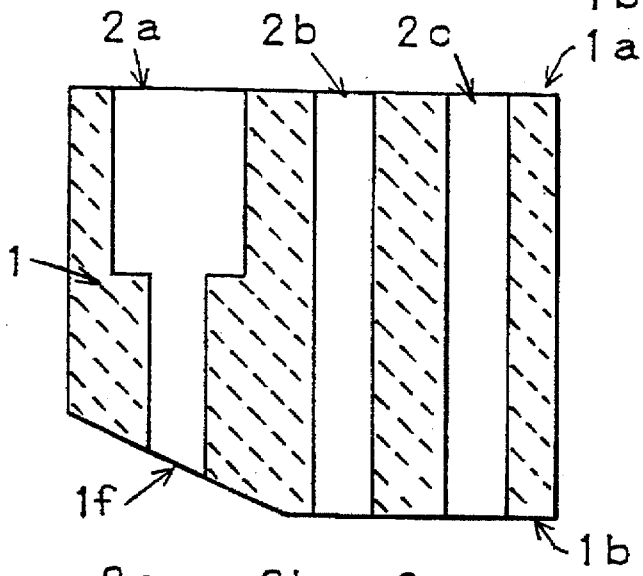
Figure 3C:
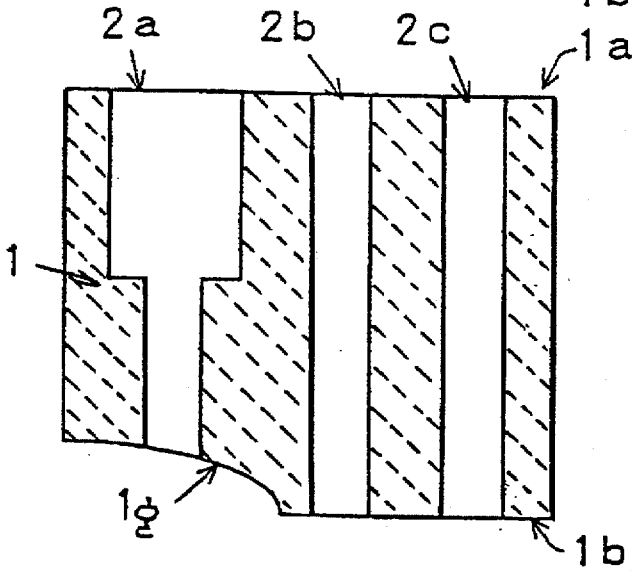

The above-described embodiments of the present invention are substantially as shown in FIGS. 1(*a*), 1(*b*), and 2, wherein the short-circuited end surface has a stepped shape having the step surface 1*d* which is perpendicular to the short-circuited end surface. Modifications of the stepped shape of the short-circuited end surface might include a step surface 1*e* formed as an inclined surface, as shown in FIG. 3(*a*), or the entirety of the removed portion of the dielectric block might be inclined to form the step surface 1*f*, as shown in FIG. 3(*b*), or the entirety of the removed portion of the dielectric block might be curved to form a curved step surface l, as shown in FIG. 3(*c*). Other structures are the same as those in FIGS. 1(*a*) and l(*b*) and description thereof is omitted.

While the dielectric filter is shown in the above embodiments as having the pair of input/output electrodes formed at predetermined positions on the outer surface of the dielectric block, alternate embodiments of the invention might contemplate connection pins, such as resin pins, which are provided in place of the input/output electrodes to achieve connection to an external circuit.

Further, while the dielectric filter is shown in the above embodiments as including three resonators, other embodiments of the invention might include two or four resonators, for example. A dielectric filter including two resonators formed in a single stepped hole and a single straight hole has a single attenuation pole on the low-frequency side alone. In the case of a dielectric filter including five resonators, if a stepped resonator hole is formed at the center while two straight holes are formed on each of the two sides of the stepped resonator hole, two attenuation poles are formed on each of the two sides of the passband. In that case, the short-circuited end surface has a stepped shape in which the central portion adjacent to the stepped hole is recessed.

As will be understood from the foregoing description, in the dielectric filter according to the present invention, the length of the portion of the dielectric block, corresponding to the resonator formed in the stepped hole, is shortened by removing part of the short-circuited end surface, and thus, the open ends of the resonators formed in the stepped and straight holes can be located at almost the same positions.

Accordingly, firm capacitive coupling can be obtained between the resonator formed in the stepped hole and the resonator formed in the straight hole adjacent to the stepped hole, and consequently, filter characteristics having a wide passband can be obtained.

Furthermore, since the inner conductor-free portion, serving as the open end of the stepped hole, can be formed close to the open-circuited end surface, formation thereof is facilitated, thus reducing the production cost.

Further, since a part of the short-circuited end surface is removed, the size of the entire filter can be reduced accordingly.

Further, in the case of a dielectric filter having three or more resonators, an attenuation pole can be formed at each of the low- and high-frequency sides of a passband. Thus, a high-performance filter exhibiting an excellent waveform symmetry property and sharp attenuation characteristics can be provided. It is thus possible according to the present invention to provide an inexpensive and small dielectric filter having a wide passband.

It is further understood by those skilled in the art that the invention is not limited by any of the details of the above description, unless otherwise specified, but rather is to be construed broadly within its spirit and scope as set out in the accompanying claims.

What is claimed is:

1. A dielectric filter comprising:

a dielectric block having a pair of opposing end surfaces, one of said end surfaces being a short-circuited end surface, said dielectric block having a stepped resonator hole and a non-stepped resonator hole, said stepped and non-stepped resonator holes extending between said pair of opposing end surfaces;

a respective inner conductor disposed on a corresponding surface of each of said stepped and non-stepped resonator holes; and an outer conductor disposed at least on said short-circuited end surface and on side surfaces of said dielectric block extending between said pair of opposing end surfaces;

wherein a length of a first portion of said dielectric block, corresponding to a stepped resonator in said stepped resonator hole, is less than a length of a second portion of said dielectric block, corresponding to a non-stepped resonator in said non-stepped resonator hole, so that said stepped resonator is shorter than said non-stepped resonator;

wherein said short-circuited end surface has a stepped shape defined by a step surface near said stepped resonator, located at said first portion of said dielectric block;

wherein said step surface defines a non-right angle with respect to said short-circuited end surface.

2. A dielectric filter according to claim 1, wherein said short-circuited end surface at said stepped resonator is parallel to said short-circuited end surface at said non-stepped resonator.

3. A dielectric filter according to claim 1, wherein said short-circuited end surface at said stepped resonator is non-parallel to said short-circuited end surface at said non-stepped resonator.

4. A dielectric filter according to claim 1, wherein said short-circuited end surface at said stepped resonator is substantially curved and said short-circuited end surface at said non-stepped resonator is substantially flat.

5. A dielectric filter according to claim 1, wherein an outer conductor-free portion is disposed on at least part of said open-circuited end surface of said dielectric block so as to separate said respective inner conductor from said outer conductor.

6. A dielectric filter according to claim 5, wherein respective resonant frequencies associated with corresponding ones of said stepped and non-stepped resonators are substantially the same.

7. A dielectric filter according to claim 5, further comprising a second said non-stepped resonator hole disposed in said dielectric block.

8. A dielectric filter according to claim 7, wherein said second non-stepped resonator hole is disposed in another portion of said dielectric block away from said stepped resonator hole, beyond said first-mentioned non-stepped resonator hole.

9. A dielectric filter according to claim 8, further comprising a coupling structure disposed in said dielectric block between said non-stepped and second non-stepped resonator holes.

10. A dielectric filter according to claim 9, wherein said coupling structure is a coupling hole.

* * * * *